United States Patent [19]

Bennett

[11] Patent Number: 4,459,058

[45] Date of Patent: Jul. 10, 1984

[54] TOPICAL PRODUCT DISPENSER

[75] Inventor: Robert A. Bennett, Easton, Conn.

[73] Assignee: AE Development Corporation, Minneapolis, Minn.

[21] Appl. No.: 479,438

[22] Filed: Mar. 28, 1983

Related U.S. Application Data

[63] Continuation-in-part of Ser. No. 417,986, Sep. 14, 1982, abandoned, which is a continuation-in-part of Ser. No. 382,072, May 26, 1982, abandoned.

[51] Int. Cl.[3] ..... A45D 40/00; A45D 40/12; A45D 40/16

[52] U.S. Cl. ..... 401/88; 401/82; 401/84; 401/98

[58] Field of Search ..... 401/49, 55, 82, 84, 401/88, 131, 87, 98, 208, 75, 83

[56] References Cited

U.S. PATENT DOCUMENTS

| | | | |
|---|---|---|---|
| 558,318 | 4/1896 | Smith et al. . | |
| 575,275 | 1/1897 | Ress | 401/83 |
| 936,133 | 10/1909 | Ibbotson . | |
| 1,887,299 | 11/1932 | Friedman . | |
| 1,978,541 | 10/1934 | Kutter . | |
| 2,276,047 | 3/1942 | Kurth | 401/88 |
| 2,412,073 | 12/1946 | Bassett . | |
| 2,814,153 | 11/1957 | Martin | 401/88 |
| 4,208,143 | 6/1980 | Nored . | |
| 4,235,557 | 11/1980 | Hayes . | |

FOREIGN PATENT DOCUMENTS

| | | | |
|---|---|---|---|
| 97798 | 9/1924 | Austria | 401/88 |
| 798715 | 11/1968 | Canada | 401/75 |
| 2259560 | 8/1975 | France | 401/88 |
| 5009 | of 1897 | United Kingdom . | |
| 537600 | 6/1941 | United Kingdom . | |
| 626944 | 7/1949 | United Kingdom . | |

*Primary Examiner*—Steven A. Bratlie
*Attorney, Agent, or Firm*—Marvin E. Jacobs

[57] ABSTRACT

The invention is directed to a topical product dispenser containing an element with a dispensible ingredient, such as a deodorant and/or antiperspirant. Prior dispensers use a screw feed with a number of parts, and the element is usually shaped with a flat surface. The improved dispenser uses fewer parts and provides an element shaped for use in an armpit. The dispenser includes a hollow, shallow circular first cylinder (16) forming a cavity for receiving a rotatable dispensible element (34) and a detachable lid for exposing the surface of the element. The solid element in the form of a second cylinder (34) is rotatably disposed in the first cylinder (16). A manually rotatable member (22) disposed in an opening in an end surface of the first cylinder (16) has an extension which penetrates and engages the second cylinder (34). The extension can contain prongs engaging opposed holes in the body of the first cylinder (16) for selective rotation of the second cylinder (34).

16 Claims, 10 Drawing Figures

TOPICAL PRODUCT DISPENSER

DESCRIPTION

1. Cross-Reference to Related Applications

This application is a continuation-in-part of copending application, Ser. No. 417,986, filed Sept. 14, 1982, entitled "Deodorant Applicator" now abandoned, which in turn is a continuation-in-part of copending application, Ser. No. 382,072, filed May 26, 1982, which is also entitled "Deodorant Applicator" now abandoned.

2. Technical Field

The present invention relates to an improved dispenser for applying solid products to surfaces and, more particularly, to a cylindrical dispenser for applying topical, solid, personal care products, such as deodorants and/or antiperspirants to the axillae of users.

3. Background Art

Dispensers for applying solid, topical products are provided in several different forms and configurations, such as narrow tubes for dispensing lip care products or larger cylinders for dispensing underarm products, such as deodorants or antiperspirants.

These dispensers require a friction or screw feed to advance and retract the product. If the product is not retracted sufficiently, the exposed surface will be deformed when the cap is replaced on the dispenser. The application surface is normally flat which does not conform to the shape of an armpit and makes application relatively difficult.

Screw feed is expensive to fabricate and does not function smoothly. The available solid applicators require manufacture of a relatively large number of parts which further adds to the cost of the product.

STATEMENT OF THE INVENTION

The dispenser of the invention includes a contoured, solid element that is more compatible in shape with the human axilla. The arcuate convex waxy surface readily fits the axilla and application of the solid product by stroking is both easy and comfortable, and more complete and effective coverage is accomplished in fewer strokes. The novel dispenser of the invention is formed of few and easily moldable parts. The solid element can be formed by casting inside the dispenser. Both of these factors are responsible for lower manufacturing cost.

The element is readily covered without contact with the exposed surface and fresh element is moved into place by rotation rather than by linear movement of the element. The dispenser is of a disc-shape which is easy and comfortable to hold and manipulate and is more compact for storage in drawers or in travel containers.

Though the principal intended use is for dispensing underarm deodorants and/or anitperspirants, the dispenser of the invention can be utilized to apply any solid to a surface by rubbing the contoured element on the surface. The element comprises mainly inert carrier, such as a waxy solid containing a minor amount of active ingredient. The inert carrier can be a wax or a gel. The element is preferably formed of a material that can be set from a liquid to a more rigid state. The inert carrier can be a thermoplastic material, such as a meltable wax or a thermosetting material that gels or sets by chemical curing agent, and/or heat or radiation. The element can be a household care product, such as an insecticide or furniture wax, etc., or a personal care product containing a dispersion or solution in the solid carrier of an active ingredient, such as an insect repellant, fungicide, sunscreen agent, analgesic or various dyes, emollients, and the like, for a lip blush, facial blush, or eye shadow. The active ingredient can be absorbable into the endodermis, such as Vitamin K or heparin. The element can be small in diameter, and or thin, such as for lip or eye product application, or wide and/or large in diameter, such as for applying a body liniment.

In accordance with the principles of this invention, a hollow shallow circular first cylinder is employed. The first cylinder has first and second parallel flat end surfaces which are interconnected by a peripheral outer wall. The first cylinder consists of a relatively large main body section incorporating major portions of said surfaces and said wall and a relatively small minor section which incorporates minor portions of the surfaces and wall. The minor section is detachably engageable with the main section and constitutes a removable cap. The contours of the engaging edges of the major and minor sections are irregular in shape but conform to each other.

The first surface has a circular opening centrally disposed therein which is located in the main section and which communicates with the interior thereof. A circular member accessible from the exterior of said first surface is disposed in and manually rotatable in the opening. The member has an axis of rotation which extends through the center of the opening at right angles to the end surfaces. The member has an integral, rigid extension extending from the member toward the second surface. The extension has an axis of symmetry coincident with the axis of rotation.

A second slightly smaller solid cylinder element which contains an active ingredient, such as a deodorant, has the same shape as the first cylinder and is disposed rotatably therein. The second cylinder is rotatable about the axis of rotation. The extension penetrates the second cylinder and is non-rotatably secured thereto.

In use, the cap is removed, exposing a portion of the second cylinder. The element can then be applied by rubbing to a surface in a conventional manner being particularly easy to apply to arm pits because of the conforming shapes of the element and armpits.

As the exposed portion of the element is used up, the member can be rotated to expose an adjacent unused portion thereof. The relative sizes of the second cylinder and the main section are so chosen that essentially the entire second cylinder can be used up before the dispenser is unusable.

These and many more features and attendant advantages of the invention will become apparent as the invention becomes better understood by reference to the following detailed description when considered in conjunction with the accompanying drawings.

DETAILED DESCRIPTION OF PREFERRED EMBODIMENT

Figure 1:
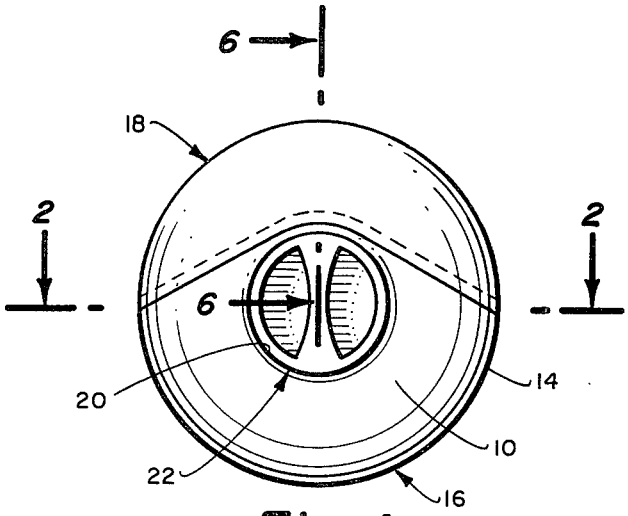
FIG. 1 is a front view of the invention.
Figure 2:
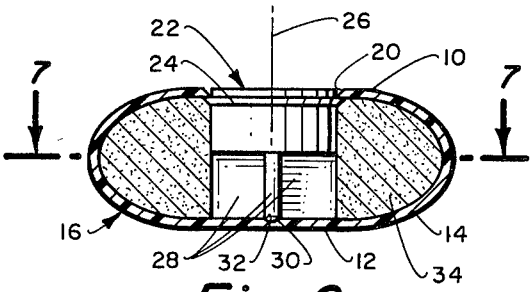
FIG. 2 is a view taken along line 2—2 in FIG. 1.
Figure 3:
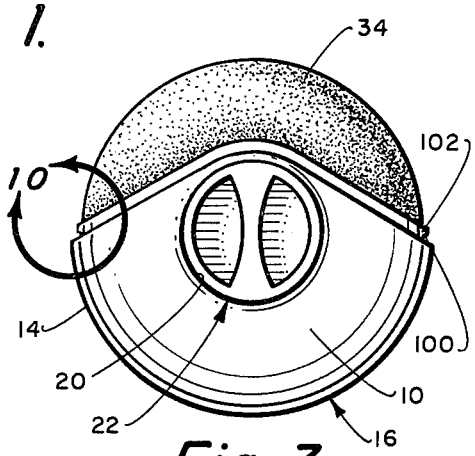
FIG. 3 is a front view of the structure shown in FIG. 1 with the minor section removed.
Figure 4:
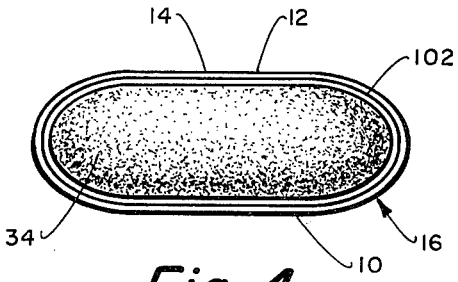
FIG. 4 is a sectional view taken on line 4—4 of FIG. 7.
Figure 5:
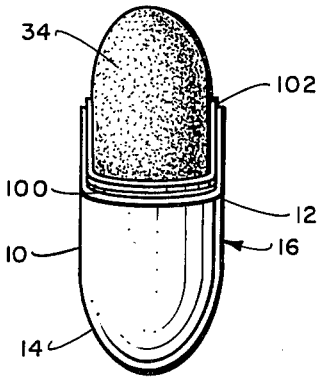
FIG. 5 is a side view of the structure shown in FIG. 3.
Figure 6:
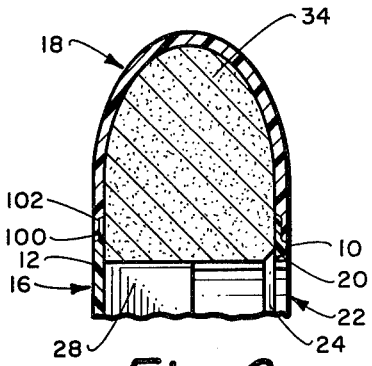
FIG. 6 is a detail cut away side view taken along line 6—6 of FIG. 1.
Figure 7:
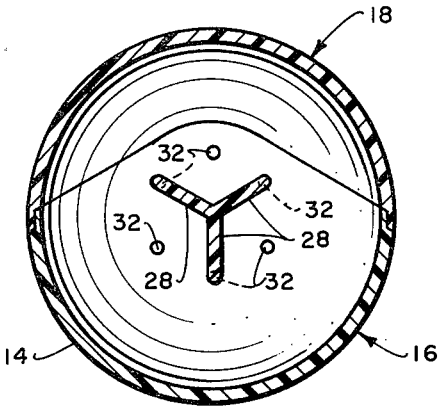
FIG. 7 is a cut away view taken along line 7—7 through the center of the structure shown in FIG. 2 with the solid cylinder removed for clarity.
Figure 8:
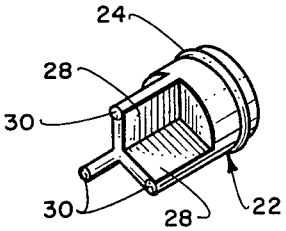
FIG. 8 is a perspective view of one of the parts used in the structure of FIG. 1.

Referring now to FIGS. 1–8 and 10, a hollow shallow circular plastic first cylinder has first and second parallel flat end surfaces 10 and 12 interconnected by a peripheral outer wall 14.

The first cylinder consists of a relatively large main body section which incorporates major portions of the end surfaces and outer wall and which is identified by 16, and a relatively small minor section which incorporates minor portions of the end surfaces and outer wall and which is identified by 18. Section 18 detachably engages section 16 and constitutes a removable cap.

Section 16 has a top opening with a peripheral lip 102 having a groove 100 which is engaged removably by a mating groove in the bottom opening of section 18 which mates therewith. These top and bottom mating openings have mating edges of irregular shape but conform to each other. These mating edges are chosen in such manner as to enable each section to be molded in a single plastic piece which can be easily removed from the mold. All parts of the invention disclosed other than the dispensible element itself can be formed out of any tough solid, such as metal or resin, but are preferably formed from a suitable casting or molding grade synthetic, organic resin.

End surface 10 has a circular opening 20 centrally disposed therein located in section 16 and communicating with the interior thereof.

A circular member 22 with an integral extension is disposed manually rotatably in the opening. Member 22 has a peripheral lip 24 which enables it to be snap fitted into the opening with the extension extending in the interior of the main section between the member and end surface 12. The member and extension have an axis of rotation 26 which extends through the center of opening 20 at right angles to the end surfaces. This axis constitutes an axis of symmetry for the extension.

The extension can be provided in various shapes, such as a single flat vane or an open or closed triangle, or other polygonal shape. The extension can be of low profile in certain uses, as member 22.

The extension shown consists of three like flat plates 28 which extend at right angles to the right end surfaces, are confluent at the axis of symmetry, and extend radially outward at 0 degrees, 120 degrees and 240 degrees therefrom. The edge of each plate adjacent end surface 12 has a small prong 30.

End surface 12 has six small holes 32 disposed equidistantly along a circular path. The member and extension are slightly movable back and forth along the axis of rotation to enable the prongs to detachably engage selected holes 32. There are six holes and three prongs.

A second slightly smaller solid cylinder 34 of the same shape as the first cylinder is a solid element and is disposed rotatably about the axis of rotation within the first cylinder.

The blades of the extension penetrate the second cylinder to key the extension and the member to the second cylinder whereby the cylinder 34 can be rotated by rotating the member. The prongs and holes enable the cylinder to be selectively locked in any desired position or rotation.

The cylinder 34 can be a waxy solid which can be poured as a liquid into the first cylinder before the member with extension is inserted into position. The liquid and cylinder are then at a temperature some tens of degrees or higher above normal ambient temperatures. As the liquid cools to room temperature it solidifies, shrinks and hardens whereby the resultant solid second cylinder is keyed permanently to the extension and is rotatable as previously described.

Figure 9:
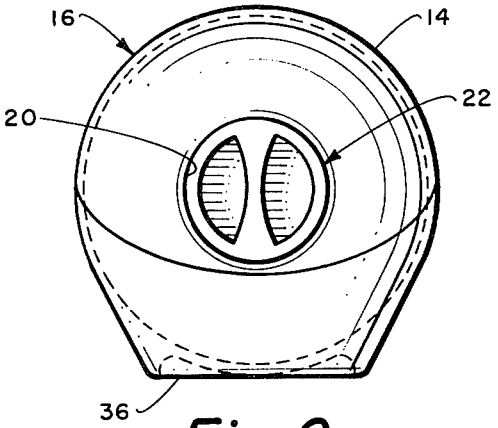
FIG. 9 shows a modification of the structure of FIG. 1.
Figure 10:
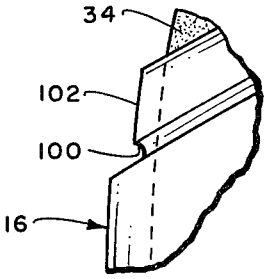
FIG. 10 is a detail view of the portion of the structure of FIG. 3 enclosed in a circle in FIG. 3.

The minor body section can have an integral small extension 36 which functions as a stand when the structure shown in FIG. 1 is inverted as shown in FIG. 9. The circular member 22 can have two holes joined by a bridge for receiving fingers of the user.

It is to be realized that only preferred embodiments of the invention have been described and that numerous substitutions, modifications and alterations are permissible without departing from the spirit and scope of the invention as defined in the following claims.

I claim:

1. An applicator comprising:

a hollow, shallow, circular first cylinder having first and second flat parallel end surfaces interconnected by a peripheral outer wall, said first cylinder being constituted by a relatively large main body section incorporating major portions of said end surfaces and said wall and a relatively small minor section which incorporates minor portions of said end surfaces and said wall, said minor section detachably engagable with said main section, and defining a removable cap for said main body section, the contours of the engaging edges of the two sections being irregular in shape but conforming to each other to form a mating, fluid-tight interface, the inner surface of which is smooth and continuous, said first surface having a centrally disposed circular opening located in the main section and communicating with the interior of the main section;

a circular member accessible from the exterior of said first surface and disposed in a manually rotatable manner within said opening, said member having an axis of rotation extending through the center of said opening at right angles to said surfaces, said member having an integral extension which extends from said member and toward said second surface and which has an axis of symmetry coincident with said axis of rotation; and the first cylinder defining a cavity, the peripheral wall of which is symmetrical with respect to the center of the opening for receiving a second slightly smaller, solid cylinder element disposed rotatably in said first cylinder.

2. An applicator according to claim 1, in which said extension penetrates the second cylinder element and is non-rotatably secured thereto.

3. An applicator according to claim 2, in which the second cylinder element comprises a solid wax or gel containing a dispersion of active ingredient.

4. An applicator according to claim 3, in which the element is selected from personal care products, household care products or pharmaceuticals.

5. An applicator according to claim 3, in which the ingredient is selected from a deodorant and/or an antiperspirant.

6. An applicator according to claim 1, in which the integral extension extends between the circular member and the second surface.

7. An applicator of claim 1, wherein said extension, as viewed in a plane parallel to said surfaces and disposed at right angles to said axis of symmetry, defines a plurality of equidistantly spaced legs which extend radially outward from the axis of symmetry and which are concurrent at said axis.

8. An applicator of claim 6, wherein said second surface has a first plurality of holes spaced along a circular path and said extension has a second plurality of prongs selectively engagable with some of said holes.

9. An applicator of claim 8, wherein said member can be moved slightly back and forth along the axis of symmetry to enable said prongs to disengage from and become engaged with selected holes.

10. An applicator according to claim 1, in which the peripheral wall is curved.

11. A method of filling a dispenser comprising the steps of:

filling the symmetrical cavity of a hollow, shallow, circular cylinder having opposed parallel side walls joined to a peripheral outer wall having a central, circular opening in one of the side walls through the opening with a congealable liquid;

placing the hub portion of a circular handle member into the liquid and rotatably and sealingly inserting the circular member into said opening;

congealing said liquid to form an element firmly engaging said hub portion.

12. A method according to claim 11, in which the liquid is a waxy material containing a dispersion of active ingredient.

13. A method according to claim 12, in which the active ingredient is selected from personal care products, household products or pharmaceuticals.

14. A method according to claim 13, in which the active ingredient is a deodorant and/or antiperspirant.

15. A dispenser for a topical product comprising in combination:

a hollow, shallow, circular first cylinder formed of a body section and a detachable lid joined to a peripheral outer surface symmetrical with respect to the center of the side wall forming a cavity having smooth, continuous, parallel side wall surfaces for receiving a rotatable dispensible element in sliding contact with said surfaces;

one of said side surfaces of the body section having a centrally disposed opening communicating with the cavity; and a member having an outer portion centrally rotatably and sealingly received in the opening joined to a hub section disposed inside the cavity for non-rotatably engaging the element and having a gripping means mounted on the outer portion of the member for manually rotating the member and element.

16. A dispenser according to claim 15 in which the inside wall surface opposite said opening contains at least one depression and said hub section contains at least one prong positioned to releasably enter said depression to temporarily lock the element in a position.

* * * * *